US011700943B1

(12) United States Patent
Wang

(10) Patent No.: US 11,700,943 B1
(45) Date of Patent: Jul. 18, 2023

(54) FOLDABLE CHAIR

(71) Applicant: Shenzhen Chuangboyou Technology Development Co., LTD, Shenzhen (CN)

(72) Inventor: Lili Wang, Shenzhen (CN)

( * ) Notice: Subject to any disclaimer, the term of this patent is extended or adjusted under 35 U.S.C. 154(b) by 0 days.

(21) Appl. No.: 18/176,266

(22) Filed: Feb. 28, 2023

(30) Foreign Application Priority Data

Jan. 13, 2023 (CN) ..... 202320148245.3

(51) Int. Cl.
*A47C 4/02* (2006.01)
*A47C 4/28* (2006.01)

(52) U.S. Cl.
CPC ..... *A47C 4/286* (2013.01)

(58) Field of Classification Search
CPC .. A47C 4/286; A47C 4/02; A47C 4/30; A47C 4/44; A47C 4/28; A47C 3/20; A47C 3/40; A47C 9/105
USPC ..... 297/16.2
See application file for complete search history.

(56) References Cited

U.S. PATENT DOCUMENTS

| | | | | |
|---|---|---|---|---|
| 2,473,090 | A * | 6/1949 | Becker | A47C 4/286 297/440.11 |
| 3,709,167 | A * | 1/1973 | Sprigman | A47C 9/105 248/435 |
| 8,979,184 | B2 * | 3/2015 | Stafford | A47C 9/105 297/16.2 |
| 11,439,238 | B1 * | 9/2022 | Wang | A47C 4/286 |
| 2009/0174233 | A1 * | 7/2009 | Hoffman | A47C 4/286 297/16.2 |
| 2014/0306493 | A1 * | 10/2014 | Obolewicz | A47C 4/42 297/16.2 |

FOREIGN PATENT DOCUMENTS

| | | |
|---|---|---|
| CN | 210870581 | * 6/2020 |
| CN | 217644857 | * 10/2022 |

* cited by examiner

*Primary Examiner* — Mark R Wendell

(57) ABSTRACT

A foldable chair includes a base, a plurality of retractable arms connected to the base, and a plurality of legs connected to the base. The base includes a support defining an inner cavity and a locking assembly received in the inner cavity. The support includes an upper receiving portion connected to the arms and a lower receiving portion connected to the legs. An end of each leg connected to the lower receiving portion is arranged with leg teeth. Leg teeth of the plurality of legs are engaged with each other to allow the plurality of legs to move synergistically. In this way, the user may not operate each leg respectively when unfolding or folding the foldable chair, operations performed on the foldable chair may be simplified, and the user experience may be improved.

10 Claims, 9 Drawing Sheets

FOLDABLE CHAIR

CROSS REFERENCE TO RELATED APPLICATIONS

The present application claims foreign priority of Chinese Patent Application No.202320148245.3, filed on Jan. 13, 2023, in the China National Intellectual Property Administration, the entire contents of which are hereby incorporated by reference in its entirety.

TECHNICAL FIELD

The present disclosure relates to the field of chairs, and in particular to a foldable chair.

BACKGROUND

Foldable chairs are a common type of chairs used in daily life and may be folded into a small size to be stored and carried easily. However, in the art, processes of folding the foldable chairs may be complicated, which seriously affects user's experience.

SUMMARY OF THE DISCLOSURE

Therefore, it is necessary to provide a foldable chair which may be folded easily.

The present disclosure provides a foldable chair, including: a base, a plurality of extendable-and-retractable arms connected to the base, and a plurality of legs connected to the base. The base includes a support defining an inner cavity and a locking assembly received in the inner cavity. The support includes an upper receiving portion connected to the plurality of arms and a lower receiving portion connected to the plurality of legs. An end of each of the plurality of legs connected to the lower receiving portion is arranged with leg teeth, and the leg teeth of one of the plurality of legs are engaged with the leg teeth of another one of the plurality of legs to allow one of the plurality of legs to move to drive the rest of the plurality of legs to move.

In some embodiments, the locking assembly includes a leg unlocking button that is inserted in the inner cavity and is slidable with respect to the support, a first spring sleeving the leg unlocking button, and a first locking block connected to the leg unlocking button. The end of each of the plurality of legs connected to the lower receiving portion defines a leg positioning slot. When the plurality of legs are unfolded with respect to the base to provide a support for the base, the first locking block is snapped in the leg positioning slot and is configured to position the plurality of legs by a spring force provided by the first spring.

In some embodiments, the end of each of the plurality of legs connected to the lower receiving portion is arranged with a leg arc portion, the leg teeth of each of the plurality of legs are distributed on both sides of the leg arc portion, and each tooth of the leg teeth is elliptically chamfered.

In some embodiments, the upper receiving portion is arranged with a stopper portion configured to limit a downward rotation angle of each of the plurality of arms.

In some embodiments, the locking assembly further includes an arm unlocking button that is inserted in the inner cavity and is slidable relative to the support, a second spring sleeving the arm unlocking button, and a second locking block connected to the arm unlocking button. An end of each of the plurality of arms connected to the upper receiving portion defines an arm positioning slot. When the plurality of arms are unfolded relative to the base, the second locking block is snapped in the arm positioning slot and is configured to position the plurality of arms by a spring force provided by the second spring.

In some embodiments, the upper receiving portion is arranged with a stopper portion configured to limit an upward rotation angle of each of the plurality of arms.

In some embodiments, each of the plurality of arms includes a front arm and a rear arm, a maximum length of the front arm is less than a maximum length of the rear arm.

In some embodiments, the stopper portion includes a front stopper portion and a rear stopper portion, an angle at which the front arm is limited by the front stopper portion to rotate is less than an angle at which the rear arm is limited by the rear stopper portion to rotate.

In some embodiments, each of the plurality of legs defines a receiving slot; and when the foldable chair is folded, each of the plurality of arms is received in the receiving slot of a corresponding one of the plurality of legs.

The present disclosure further provides a foldable chair, including a first base, a second base spaced apart from the first base, a crossbar connecting the first base and the second base, a plurality of first support members connected to a side of the first base away from the crossbar, and a plurality of second support members connected to a side of the second base away from the crossbar. The first base includes a first support defining a first inner cavity and a first locking assembly received in the first inner cavity, the second base comprises a second support defining a second inner cavity and a second locking assembly received in the second inner cavity. An end of each of the plurality of first support members connected to the first base is arranged with first teeth, the first teeth of one of the plurality of first support members are engaged with the first teeth of another one of the plurality of first support members to allow one of the plurality of first support members to move to drive the rest of the plurality of first support members to move. An end of each of the plurality of second support members connected to the second base is arranged with second teeth, the second teeth of one of the plurality of second support members are engaged with the second teeth of another one of the plurality of second support members to allow one of the plurality of second support members to move to drive the rest of the plurality of second support members to move.

According to the present disclosure, the foldable chair includes the base, a plurality of extendable-and-retractable arms connected to the base, and a plurality of legs connected to the base. The base includes a support defining the inner cavity and the locking assembly received in the inner cavity. The support includes the upper receiving portion connected to the arms and the lower receiving portion connected to the legs. The end of each leg connected to the lower receiving portion is arranged with leg teeth. The leg teeth of the plurality of legs are engaged with each other, such that such that motion of one of the plurality of legs may drive the rest of the plurality of legs to move. In this way, when the user is unfolding or folding the foldable chair, the user may not need to perform operations on each leg respectively. Operations performed on the foldable chair may be simplified, and the user experience may be improved.

BRIEF DESCRIPTION OF THE DRAWINGS

In order to illustrate technical solutions in the embodiments of the present disclosure or in the art more clearly, the accompanying drawings for description of the embodiments of the present disclosure or for the art will be introduced in brief. Apparently, the accompanying drawings in the following description are some of the embodiments of the present disclosure, and other accompanying drawings may be obtained based on these drawings without any creative work by any ordinary skilled person in the art.

DETAILED DESCRIPTION

Figure 1:
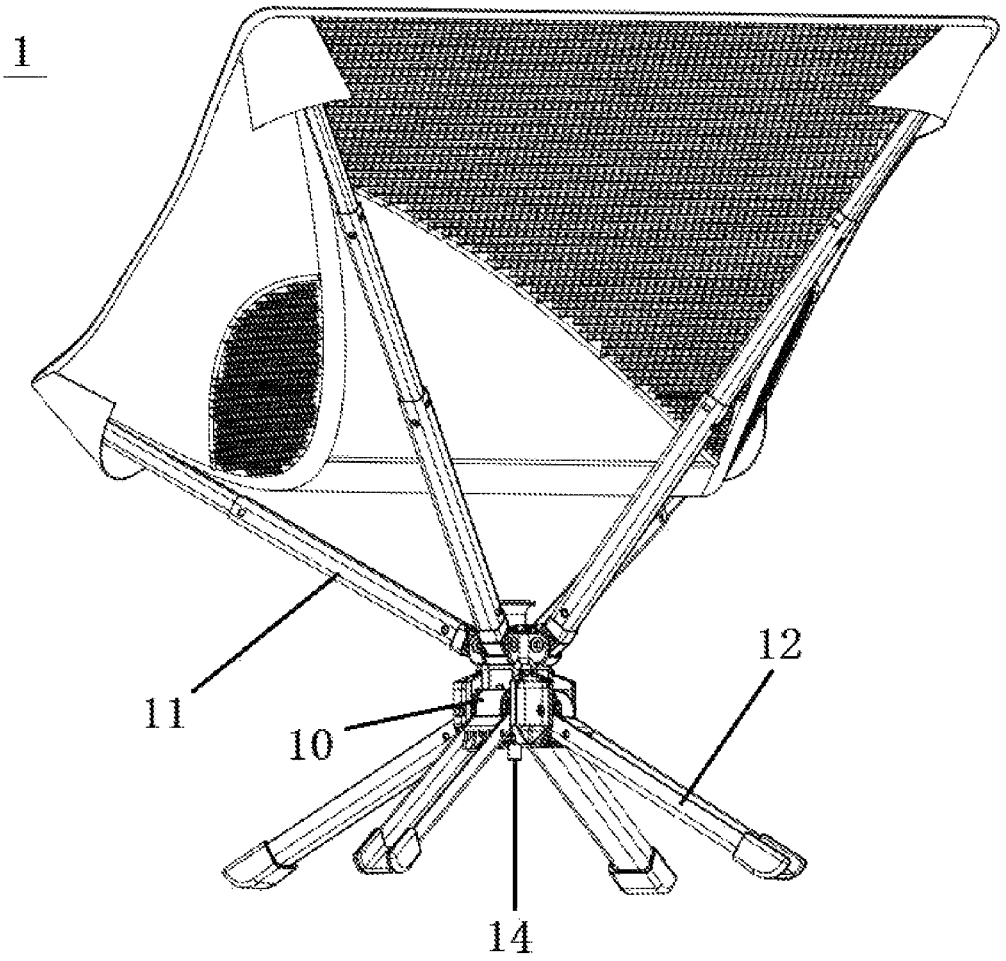
FIG. 1 is a schematic view of a foldable chair after being assembled according to an embodiment of the present disclosure.
Figure 2:
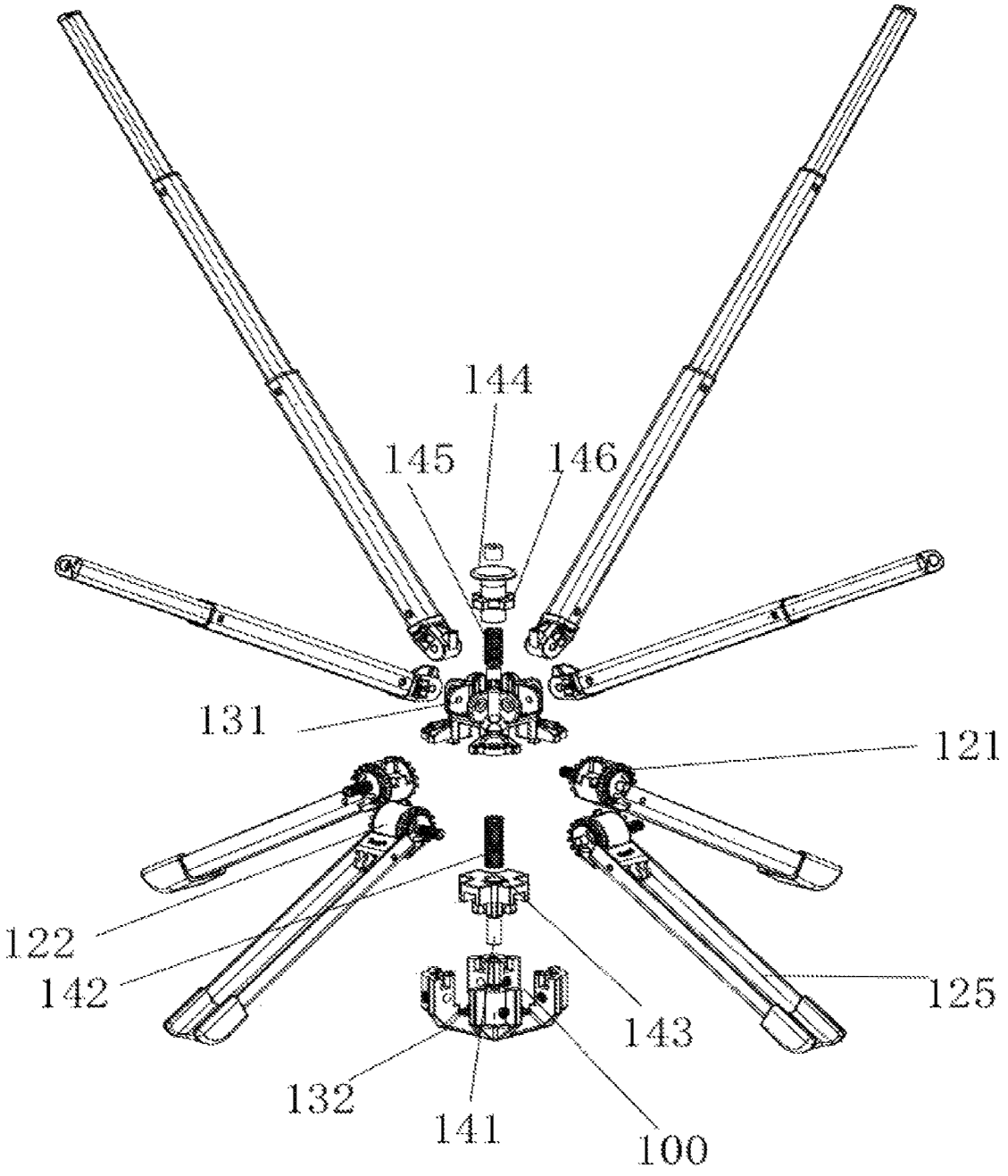
FIG. 2 is an exploded schematic view of a foldable chair according to an embodiment of the present disclosure.
Figure 3:
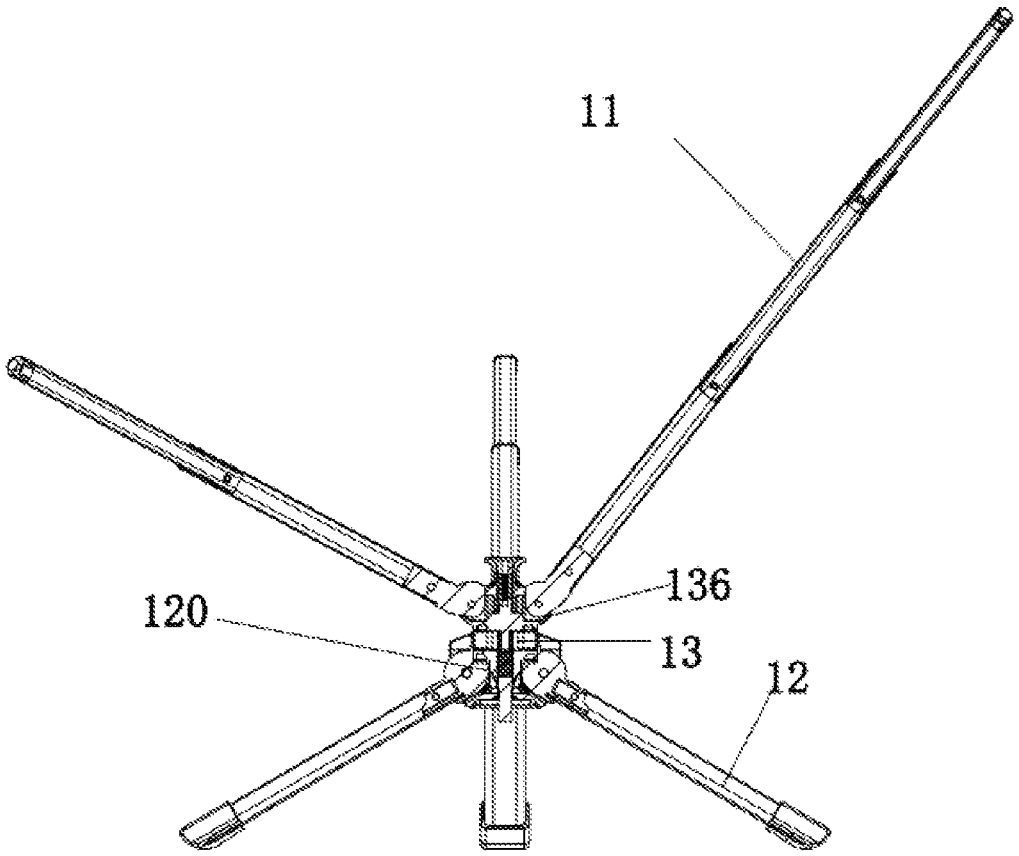
FIG. 3 is a cross-sectional view of a foldable chair in an unfolded state according to an embodiment of the present disclosure.
Figure 4:
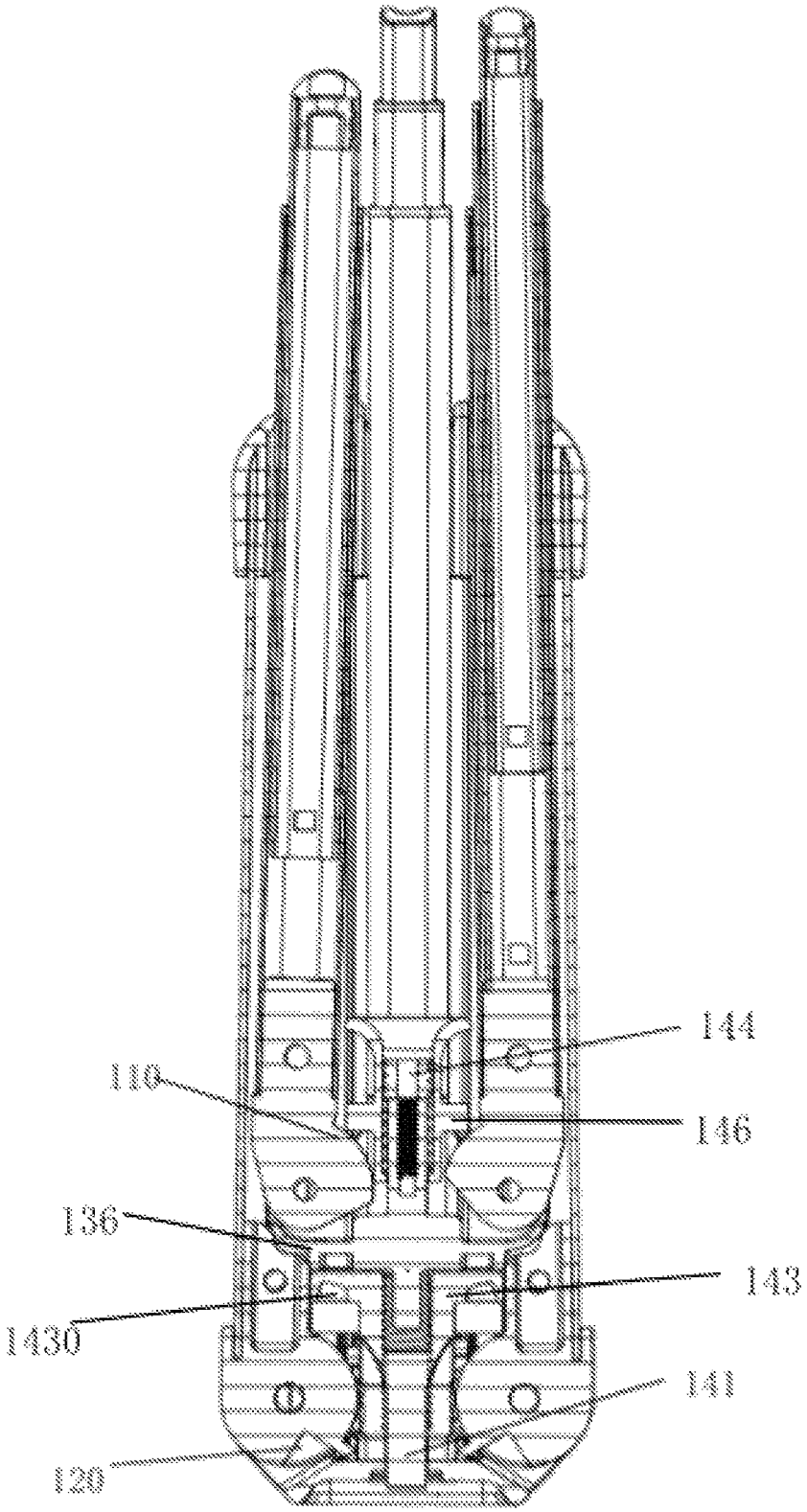
FIG. 4 is a cross-sectional view of a foldable chair in a folded state according to an embodiment of the present disclosure.

Technical solutions of the present disclosure will be clearly and completely described below by referring to the accompanying drawings. Obviously, the described embodiments are part of but not all of the embodiments of the present disclosure. All other embodiments obtained by any ordinary skilled person in the art based on the embodiments of the present disclosure without making creative work shall fall within the scope of the present disclosure.

To be noted that, in the description of the present disclosure, terms of "center", "up", "down", "left", "right", "vertical", "horizontal", "inner", "outer", and so on, are used to indicate an orientation or a position as shown in the attached drawings. The terms are used only for the purpose of facilitating and simplifying description of the present disclosure, but not to indicate or imply that a device or an element referred to must have a particular orientation, or must be constructed and operate in a particular orientation. Therefore, the terms shall not be interpreted as limiting the present disclosure. Furthermore, terms "first", "second" and "third" are used for descriptive purposes only and shall not be interpreted as indicating or implying relative importance.

As shown in FIGS. 1 to 4, the present disclosure provides a foldable chair 1 including a base 10, four extendable-and-retractable arms 11 connected to the base 10, and four legs 12 connected to the base 10. The base 10 includes a support 13 defining an inner cavity 100 and a locking assembly 14 received in the inner cavity 100. The support 13 includes an upper receiving portion 131 connected to the arms 11 and a lower receiving portion 132 connected to the legs 12. An end of each leg 12 connected to the lower receiving portion 132 is arranged with leg teeth 121. Leg teeth 121 of the plurality of legs 12 are engaged with each other, such that motion of one of the plurality of legs 12 may drive the rest of the plurality of legs 12 to move.

In detail, the locking assembly 14 includes a leg unlocking button 141 inserted in the inner cavity 100 and slidable with respect to the support 13, a first spring 142 sleeving the leg unlocking button 141, and a first locking block 143 connected to the leg unlocking button 141. The end of each leg 12 connected to the lower receiving portion 132 defines a leg positioning slot 120. When the legs 12 are extended with respect to the base 10 to provide a support for the base 10, the first locking block 143 is snapped in the leg positioning slot 120 and positions the legs by a spring force provided by the first spring 142.

In some embodiments, the end of each leg 12 connected to the lower receiving portion 132 is arranged with a leg arc portion 122. The leg teeth 121 are distributed on both sides of the leg arc portion 122. Each tooth of the leg teeth 121 is elliptically chamfered.

In the present embodiment, the upper receiving portion 131 is arranged with a stopper portion 136 to limit a downward rotation angle of each arm 11. When the arms 11 are unfolded, the arms 11 may be limited by the stopper portion 136 and may not further fold downwardly, such that the foldable chair may stand stably. The locking assembly 14 further includes an arm unlocking button 144 inserted in the inner cavity 100 and slidable relative to the support 13, a second spring 145 sleeving the arm unlocking button 144, and a second locking block 146 connected to the arm unlocking button 144. An end of each arm 11 connected to the upper receiving portion 131 defines an arm positioning slot 110. When the arms 11 are unfolded relative to the base 10, the second locking block 146 is snapped in the arm positioning slot 110 and positions the arms 11 by a spring force provided by the second spring 145.

When the foldable chair 1 needs to be folded, the leg unlocking button 141 may be pressed to allow the plurality of legs 12 to move into a retracted state at the same time. In detail, the plurality of legs 12 rotate upwards at the same time by taking the lower receiving portion 132 as a rotating center. Pressing the arm unlocking button 144 may allow the plurality of arms 11 to move to a retracted state at the same time. In detail, the plurality of arms 11 rotate upwards at the same time by taking the upper receiving portion 131 as a rotating center. Rotation may be completed when the plurality of arms 11 are approximately parallel to the plurality of legs 12. In this way, the arms 11 and the legs 12 may be transitioned between the expanded state and the retracted state, folding and unfolding operations may be performed easily.

In some embodiments, each leg 12 defines a receiving slot 125. When the foldable chair is folded, each arm 11 is stored in one corresponding leg 12, such that a size of the foldable chair is reduced.

Figure 5:
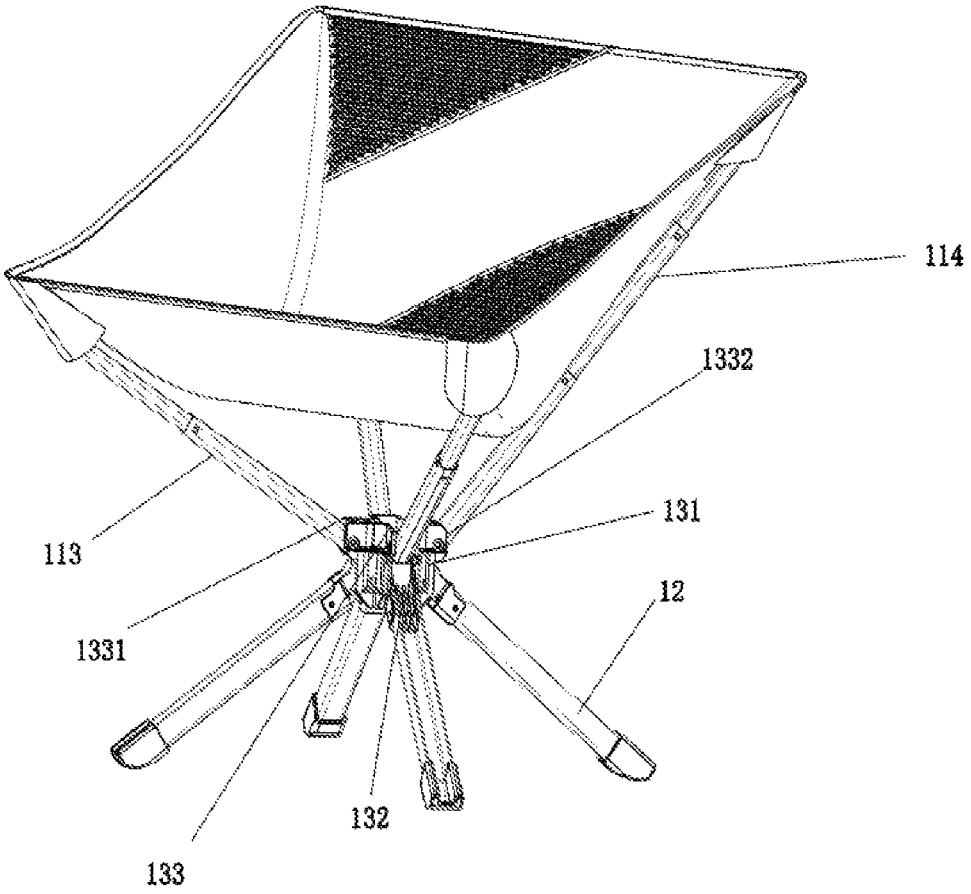
FIG. 5 is a schematic view of a foldable chair after being assembled according to another embodiment of the present disclosure.
Figure 6:
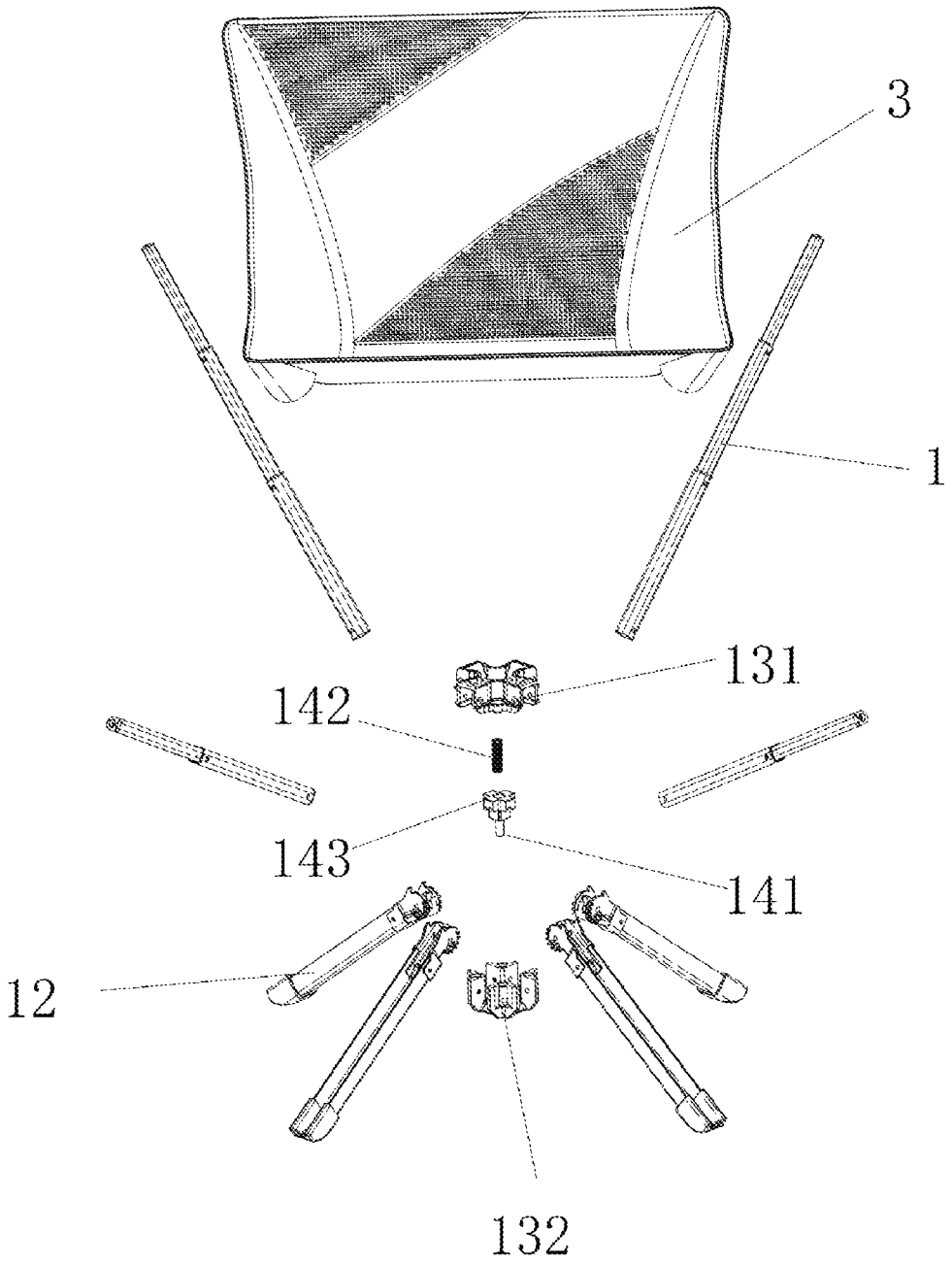
FIG. 6 is an exploded schematic view of a foldable chair according to another embodiment of the present disclosure.
Figure 7:
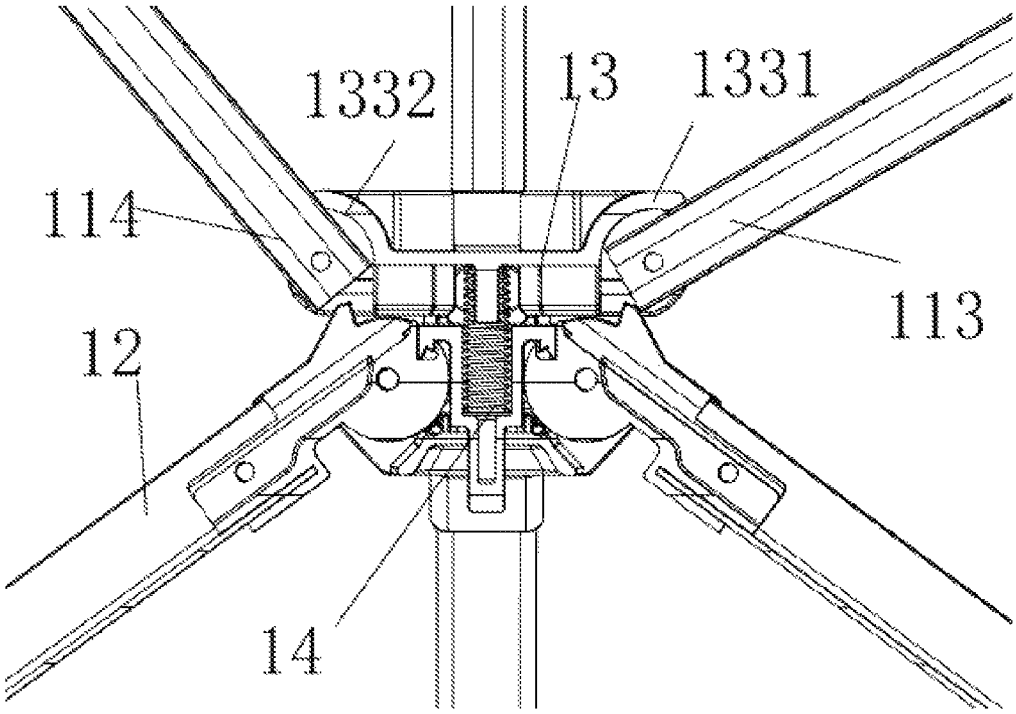
FIG. 7 is a cross-sectional schematic view of a portion of a foldable chair according to another embodiment of the present disclosure.

As shown in FIGS. 5 to 7, in another embodiment, the upper receiving portion 131 is arranged with a stopper portion 133 configured to limit an upward rotation angle of each arm 11. Each arm 11 includes a front arm 113 and a rear arm 114. A maximum length of the front arm 113 is less than a maximum length of the rear arm 114. The stopper portion 133 includes a front stopper portion 1331 and a rear stopper portion 1332. An angle at which the front arm 113 is limited by the front stopper portion 1331 to rotate is less than an angle at which the rear arm 114 is limited by the rear stopper portion 1332 to rotate. Due to the stopper portion 133, the angle at which each arm 11 can rotate upwards is limited. When the plurality of extendable-and-retractable arms 11 are extended, a tension provided by a seat fabric 3, which is connected to the arms 11, may be taken to prevent the arms 11 from moving downwards. When the foldable chair 1 needs to be folded, the leg unlocking button 141 may be pressed to allow the plurality of legs 12 to rotate downwards at the same time by taking the lower receiving portion 132 as the rotating center, and at the same time, the plurality of arms 11 are retracted and drop downwards naturally, such that the foldable chair is folded.

Figure 8:
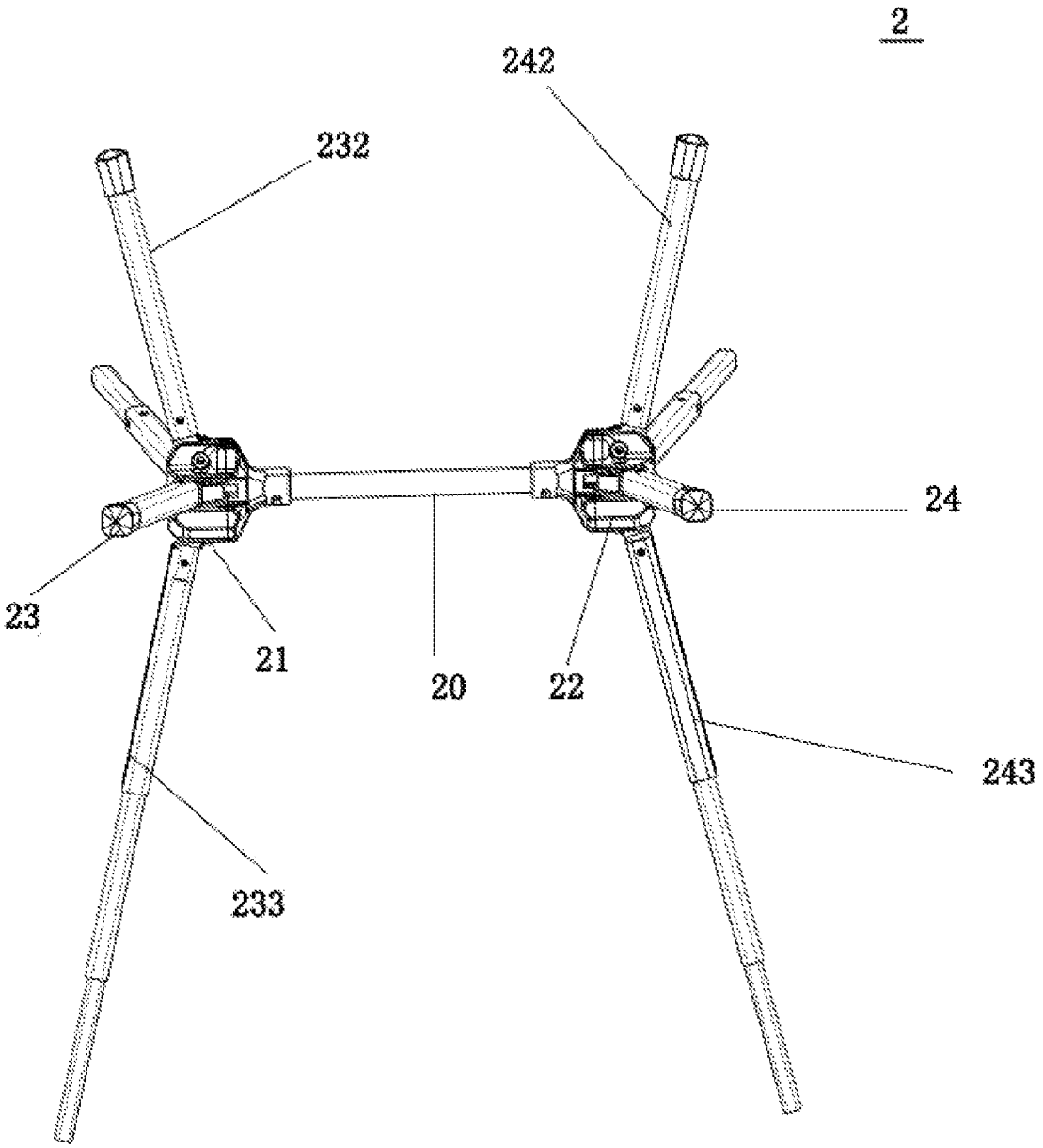
FIG. 8 is a schematic view of a foldable chair after being assembled according to still another embodiment of the present disclosure.
Figure 9:
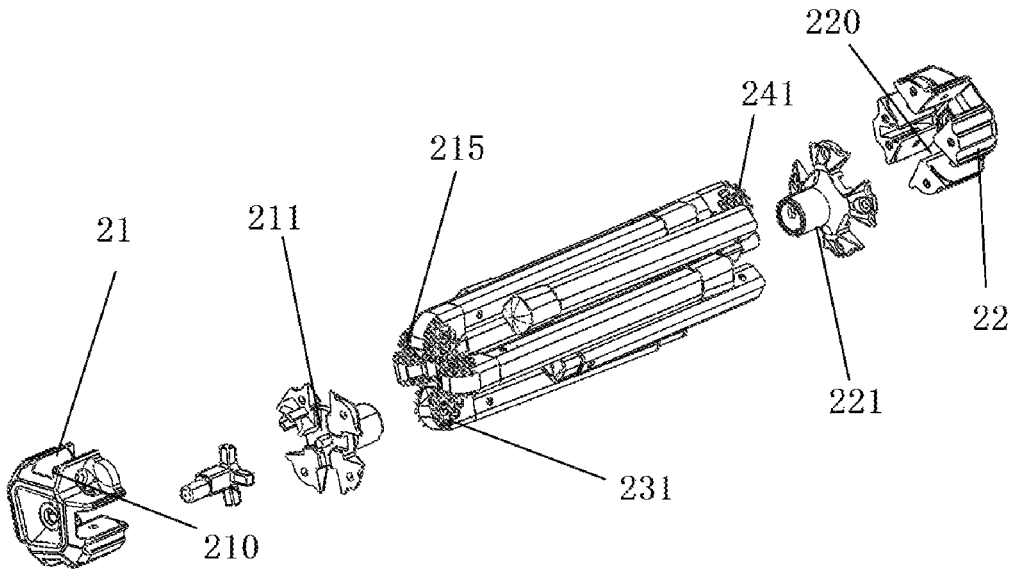
FIG. 9 is an exploded schematic view of a foldable chair according to still another embodiment of the present disclosure.

As shown in FIG. 8 and FIG. 9, the present disclosure further provides a foldable chair 2 including a first base 21, a second base 22 spaced apart from the first base 21, a crossbar 20 connecting the first base 21 and the second base 22, a plurality of first support members 23 connected to a side of the first base 21 away from the crossbar 20, and a plurality of second support members 24 connected to a side of the second base 22 away from the crossbar 20. The first base 21 includes a first support defining a first inner cavity 210 and a first locking assembly 212 received in the first inner cavity 210. The second base 22 includes a second support 221 defining a second inner cavity 220 and a second locking assembly (now shown in the drawings) received in the second inner cavity 210. An end of each first support member 23 connected to the first base 21 is arranged with first teeth 231. First teeth 231 of the plurality of first support members 23 are engaged with each other, such that motion of one of the plurality of first support members 23 may drive the rest of the plurality of first support members 23 to move. An end of each second support member 24 connected to the second base 22 is arranged with second teeth 241. Second teeth 241 of the plurality of second support members 24 are engaged with each other, such that motion of one of the plurality of second support members 24 may drive the rest of the plurality of second support members 24 to move.

The plurality of first support members 23 include two first legs 232 and two extendable-and-retractable first arms 233. The plurality of second support members 24 include two second legs 242 and two extendable-and-retractable second arms 243. It shall be understood that the legs are configured to be disposed on a supporting surface such as the ground to allow the foldable chair to stand stably. The arms are configured to support the seat fabric to form a seat to allow a person to sit on. The arm having a large length may serve as a support for a backrest part of the chair. In order to make the user comfortable when sitting on the chair, an angle formed between the four first support members 23 is not 90° in a plane perpendicular to the crossbar 20, and an angle formed between the four second support members 24 is not 90° in the plane perpendicular to the crossbar 20. Therefore, in the present embodiment, the first base 21 further includes a first auxiliary gear 215 disposed between the first teeth 231 of one of the plurality of first support members 23 and the first teeth 231 of another one of the plurality of first support members 23. The auxiliary gear may be engaged with the teeth of the plurality of first support members 23 to ensure that the teeth of the plurality of first support members 23 may move synergistically. The second base 22 is in mirroring to the first base 21.

According to the present disclosure, the foldable chair includes the base, a plurality of extendable-and-retractable arms connected to the base, and a plurality of legs connected to the base. The base includes a support defining the inner cavity and the locking assembly received in the inner cavity. The support includes the upper receiving portion connected to the arms and the lower receiving portion connected to the legs. The end of each leg connected to the lower receiving portion is arranged with leg teeth. The leg teeth of the plurality of legs are engaged with each other, such that such that motion of one of the plurality of legs may drive the rest of the plurality of legs to move. In this way, when the user is unfolding or folding the foldable chair, the user may not need to perform operations on each leg respectively. Operations performed on the foldable chair may be simplified, and the user experience may be improved.

The above embodiments are described only to illustrate the technical solutions of the present disclosure, but do not to limit the present disclosure. Despite the detailed description of the present disclosure with reference to the embodiments, any ordinary skilled person in the art shall understand that, the technical solutions described in the embodiments may be modified, or some or all of the technical features may be replaced with equivalent technical features. These modifications or replacements shall not take the essence of the corresponding technical solutions out of the scope of the present disclosure.

What is claimed is:

1. A foldable chair, comprising: a base, a plurality of extendable-and-retractable arms connected to the base, and a plurality of legs connected to the base, wherein, the base comprises a support defining an inner cavity and a locking assembly received in the inner cavity, the support comprises an upper receiving portion connected to the plurality of arms and a lower receiving portion connected to the plurality of legs, an end of each of the plurality of legs connected to the lower receiving portion is arranged with leg teeth, and the leg teeth of one of the plurality of legs are engaged with the leg teeth of another one of the plurality of legs to allow one of the plurality of legs to move to drive the rest of the plurality of legs to move.

2. The foldable chair according to claim 1, wherein the locking assembly comprises a leg unlocking button that is inserted in the inner cavity and is slidable with respect to the support, a first spring sleeving the leg unlocking button, and a first locking block connected to the leg unlocking button;

the end of each of the plurality of legs connected to the lower receiving portion defines a leg positioning slot;

when the plurality of legs are unfolded with respect to the base to provide a support for the base, the first locking block is snapped in the leg positioning slot and is configured to position the plurality of legs by a spring force provided by the first spring.

3. The foldable chair according to claim 2, wherein the end of each of the plurality of legs connected to the lower receiving portion is arranged with a leg arc portion, the leg teeth of each of the plurality of legs are distributed on both sides of the leg arc portion, and each tooth of the leg teeth is elliptically chamfered.

4. The foldable chair according to claim 2, wherein the upper receiving portion is arranged with a stopper portion configured to limit a downward rotation angle of each of the plurality of arms.

5. The foldable chair according to claim 4, wherein the locking assembly further comprises an arm unlocking button that is inserted in the inner cavity and is slidable relative to the support, a second spring sleeving the arm unlocking button, and a second locking block connected to the arm unlocking button;

an end of each of the plurality of arms connected to the upper receiving portion defines an arm positioning slot;

when the plurality of arms are unfolded relative to the base, the second locking block is snapped in the arm positioning slot and is configured to position the plurality of arms by a spring force provided by the second spring.

6. The foldable chair according to claim 2, wherein the upper receiving portion is arranged with a stopper portion configured to limit an upward rotation angle of each of the plurality of arms.

7. The foldable chair according to claim 6, wherein each of the plurality of arms comprises a front arm and a rear arm, a maximum length of the front arm is less than a maximum length of the rear arm.

8. The foldable chair according to claim 7, wherein the stopper portion comprises a front stopper portion and a rear stopper portion, an angle at which the front arm is limited by the front stopper portion to rotate is less than an angle at which the rear arm is limited by the rear stopper portion to rotate.

9. The foldable chair according to claim 2, wherein each of the plurality of legs defines a receiving slot; and when the foldable chair is folded, each of the plurality of arms is received in the receiving slot of a corresponding one of the plurality of legs.

10. A foldable chair, comprising a first base, a second base spaced apart from the first base, a crossbar connecting the first base and the second base, a plurality of first support members connected to a side of the first base away from the crossbar, and a plurality of second support members connected to a side of the second base away from the crossbar;

wherein, the first base comprises a first support defining a first inner cavity and a first locking assembly received in the first inner cavity, the second base comprises a second support defining a second inner cavity and a second locking assembly received in the second inner cavity;

an end of each of the plurality of first support members connected to the first base is arranged with first teeth, the first teeth of one of the plurality of first support members are engaged with the first teeth of another one of the plurality of first support members to allow one of the plurality of first support members to move to drive the rest of the plurality of first support members to move;

an end of each of the plurality of second support members connected to the second base is arranged with second teeth, the second teeth of one of the plurality of second support members are engaged with the second teeth of another one of the plurality of second support members to allow one of the plurality of second support members to move to drive the rest of the plurality of second support members to move.

* * * * *